US005987941A

United States Patent [19]

Zocco

[11] Patent Number: 5,987,941

[45] Date of Patent: Nov. 23, 1999

[54] WEAPONS SECURITY APPARATUS

[76] Inventor: Chris J. Zocco, 4444 Alpine Way, Murfreesboro, Tenn. 37129

[21] Appl. No.: 09/069,503

[22] Filed: Apr. 29, 1998

Related U.S. Application Data

[60] Provisional application No. 60/045,396, May 1, 1997.

[51] Int. Cl.[6] ..... E05B 65/00

[52] U.S. Cl. ..... 70/63; 109/59 R

[58] Field of Search ..... 70/63; 109/50–53, 109/59 R, 69, 45, 47; 220/334, 210; 206/1.5, 317

[56] References Cited

U.S. PATENT DOCUMENTS

| | | | |
|---|---|---|---|
| 4,615,281 | 10/1986 | Gaston | 70/63 X |
| 4,651,544 | 3/1987 | Hungerford | 70/63 |
| 4,768,021 | 8/1988 | Ferraro | 70/63 X |
| 4,788,838 | 12/1988 | Cislo | 70/63 |
| 4,850,287 | 7/1989 | Lichter | 109/59 R |
| 5,009,088 | 4/1991 | Cislo | 70/63 |
| 5,111,755 | 5/1992 | Rouse | 70/63 X |
| 5,161,396 | 11/1992 | Loeff | 70/63 |
| 5,329,865 | 7/1994 | McWard | 70/63 X |
| 5,701,770 | 12/1997 | Cook et al. | 70/63 |
| 5,794,466 | 8/1998 | Hungerford et al. | 70/63 |

*Primary Examiner*—Suzanne Dino Barrett

[57] ABSTRACT

Disclosed is a weapons vault specifically designed to operate within the parameters of security and restricted access systems. The said weapons vault consists of an electronic enclosure having an asymmetrical shaped hopper capable of holding a pistol or hand gun. The hopper is secured into place by a solenoid locking mechanism and through the force of gravity, the hopper can physically move the pistol or handgun outside of the electronic enclosure. Provided in the electronic enclosure is a magnetic micro switch detecting the position of the hopper in the open or closed position. The electronic enclosure is also provided with flush mounting features, and industry standard equipment for versatility of operating methods. The weapons vault can be connected to most any security or restricted access systems as an accessory capable of being programmed to effect various signals for dispatch.

1 Claim, 7 Drawing Sheets

WEAPONS SECURITY APPARATUS

CROSS REFERENCE TO RELATED APPLICATIONS

This claims the benefit of U.S. Provisional Application No. 60/045,396, filed May 1, 1997.

BACKGROUND OF INVENTION

In an effort to address the issue of restricting access to loaded handguns, the Weapons Security Apparatus described herein achieves a different approach to this issue. With over ten years of experience in the security and restricted access industry, I Chris J. Zocco designed this device to be compatible with existing systems in the security industry. The Weapons Security Apparatus can be connected to any Burglar, Security, or Restricted access system, and is considered to be an "accessory" to said systems. The Weapons Security Apparatus was designed to, and is proposed to meet UL standard 50 for electronic enclosures, as well as National Burglar and Fire Alarm Associations installation requirements in that it affords the minimum power supply features needed to properly connect to existing security/restricted access systems. The overall intent is to make available for installation, a Weapons Security Apparatus that will restrict access to authorized users with the potential to generate required signals for industry communications equipment for police dispatch. The general nature of the Weapons Security Apparatus affords security industry experts the ability to design standard or custom installations utilizing the apparatus as the basic accessory needed, and adding to it various methods of operation. Features needed to add operating methods such as keypads, readers etc. have been designed into the Weapons Security Apparatus for proper connection and mounting.

SUMMARY OF THE INVENTION

A Weapon Security Apparatus for enclosing a hand-holdable weapon such as a firearm (e.g. a pistol) is provided. The apparatus may operate as an accessory module within an integrated security/restricted access system or in a stand alone environment. The apparatus comprises a hopper or enclosure is adapted to be opened by actuation of a solenoid latching assembly via a signal command from a control device which may be initiated by the user. The solenoid latching assembly also may be actuated by an encoded keyboard command, or the like, directly entered into the control panel of the apparatus. The system may be wired into a general security system and monitored be a central surveillance station capable of dispatching police or other assistance. In the stand alone mode, opening of the hopper may trigger a local alarm such as a siren, flashing light, or the like.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
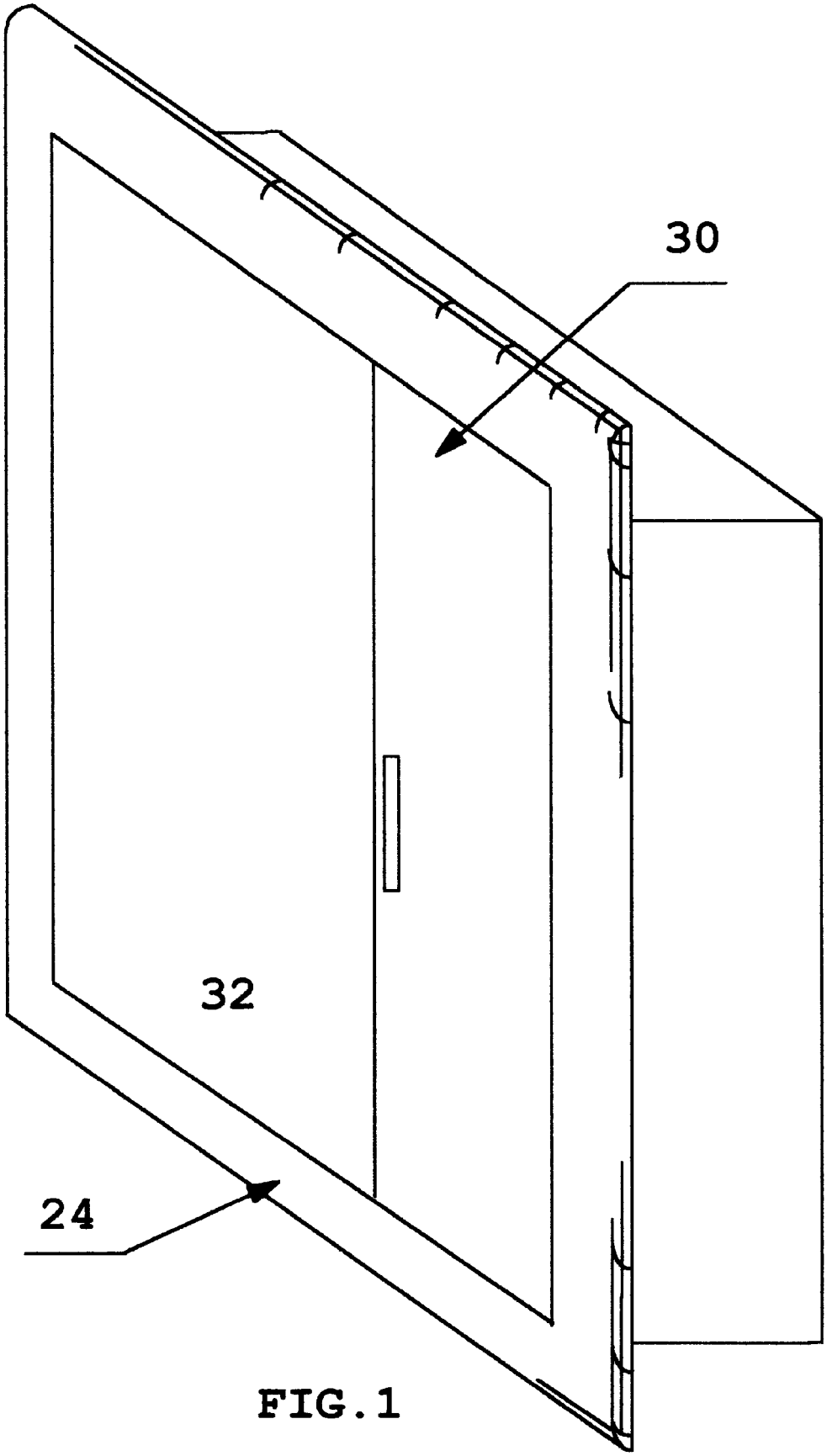
FIG. 1 is a perspective view showing the front of the weapon enclosure according to the present invention.

With reference to the drawings, a new and improved Weapon Security Apparatus embodying the principles and concepts of the present invention now will be described.

Turning initially to FIGS. 1–6, there is shown in a preferred form the Weapon Security Apparatus of the invention generally designated by reference sign 10 mounted in a wall 11 and adapted to safely and securely enclose therein in a concealed manner a small weapon such as a hand gun, pistol or the like. The apparatus 10, in turn, is divided into two compartments 12, 14 situated generally side-by-side, one of which houses a pivotal weapon-storage hopper 16 and the other of which comprises a storage compartment for various control components. The two compartments 12, 14 are formed from a generally rectangular box-like structure 20 having a vertically extending divider wall 22 therebetween. The front of the box-like structure includes a surrounding frame 24 for facilitating neatly mounting of the apparatus 10 in a suitable cutout in wall 11 to give the general appearance depicted in FIG. 1.

Figure 2:
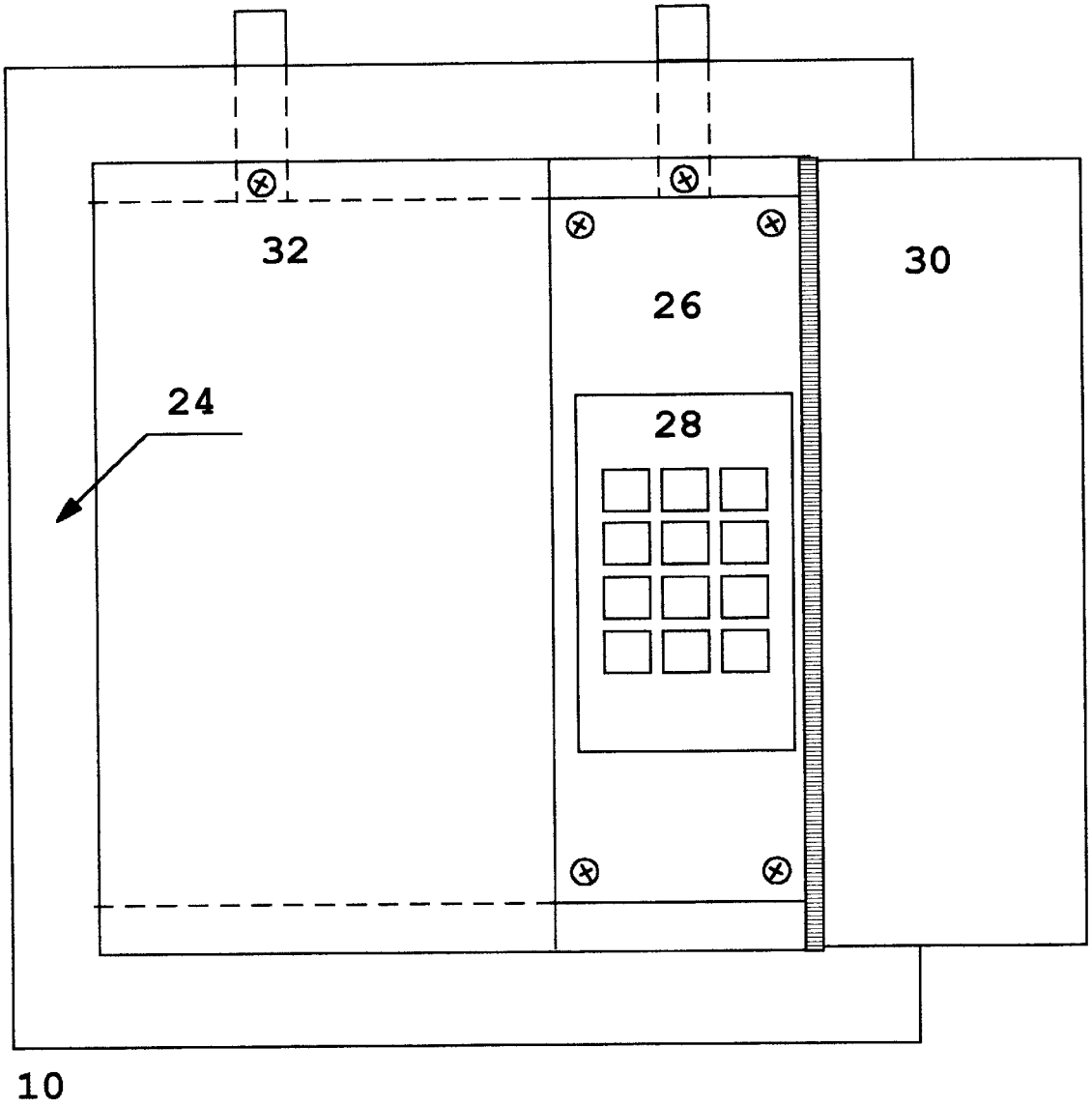
FIG. 2 is a front view of the enclosure of FIG. 2 showing the control panel cover thereof in the open condition ready for use.
Figure 3:
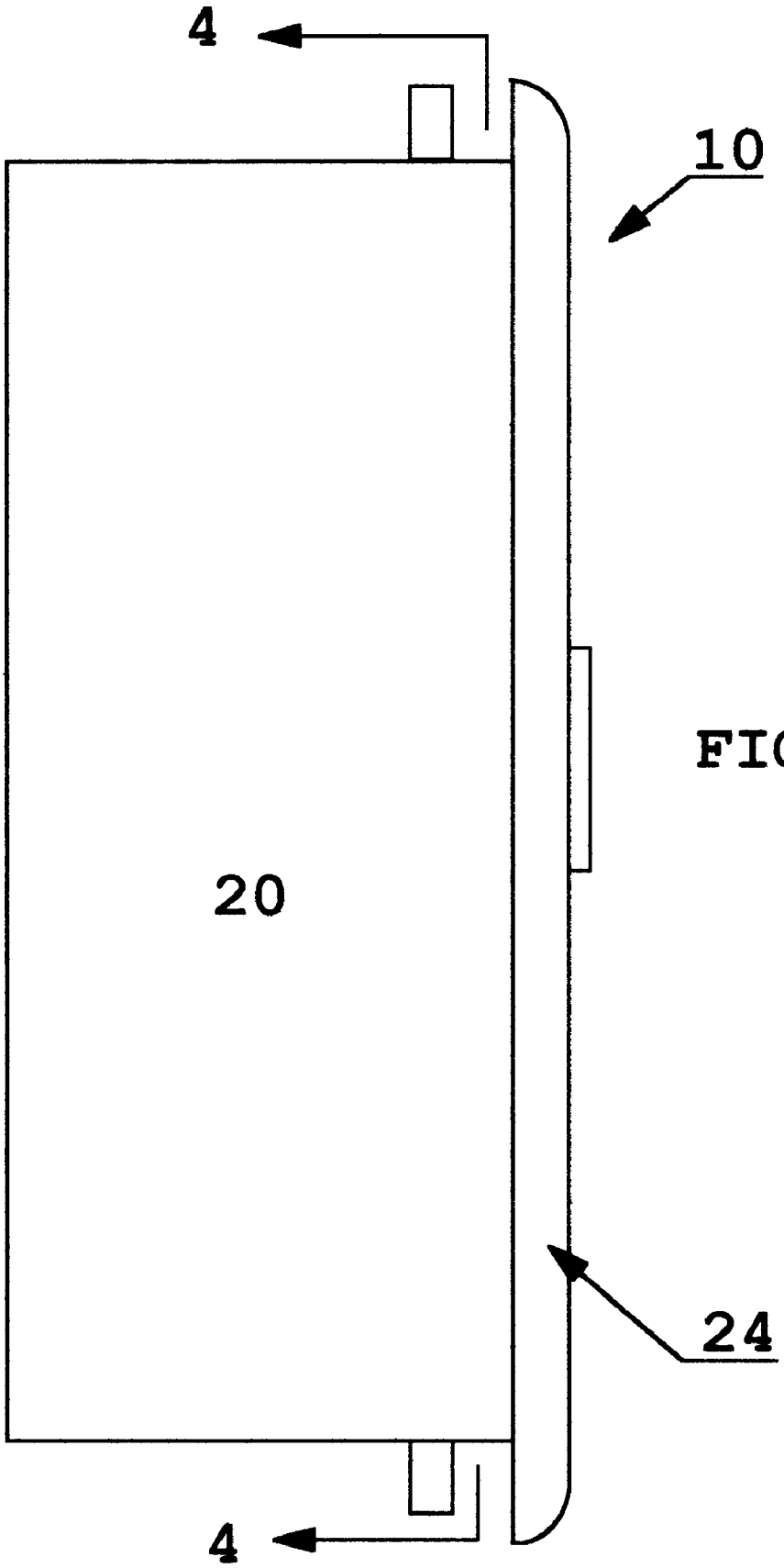
FIG. 3 is a side view of the enclosure of FIGS. 1 and 2.

The control compartment 14 is confined by a front panel 26 in which is provided a standard mounting template described in the electrical industry as a "single gang" opening where various controlling devices can be mounted. FIG. 2 shows a input keypad 28 mounted into the single gang opening as an example. As shown in FIG. 1, keypad 28 (or other similar devices) normally are concealed from view by a hinged access cover 30 (shown in the open position in FIG. 2). When viewed from the front (FIGS. 1 and 2) in the closed condition of apparatus 10, the front panel 32 of hopper 16 is flush within the surrounding frame 24 to present an innocuous appearance.

Figure 4:
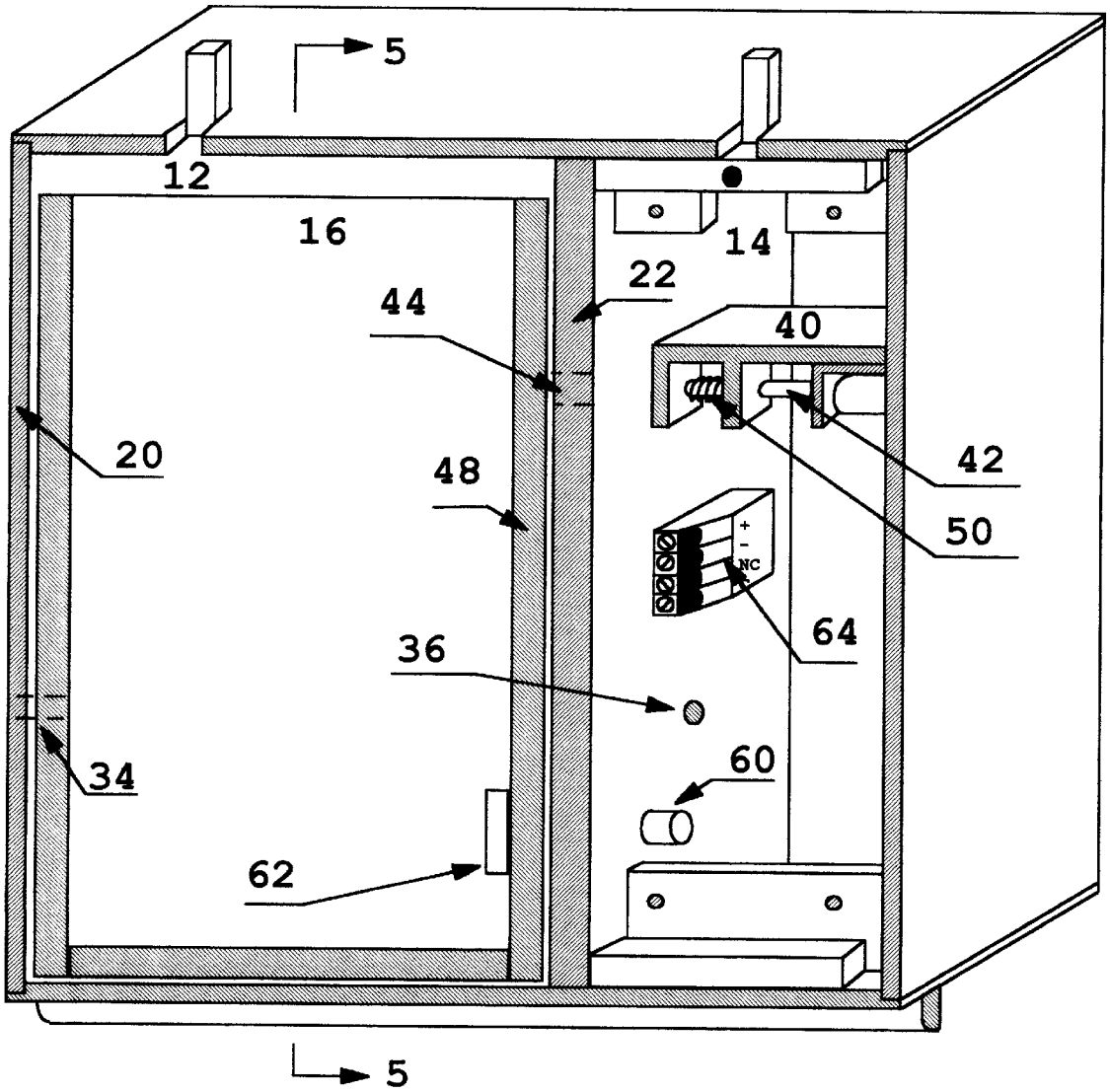
FIG. 4 is an elevational cross-sectional view taken along line 4—4 of FIG. 3.
Figure 5:
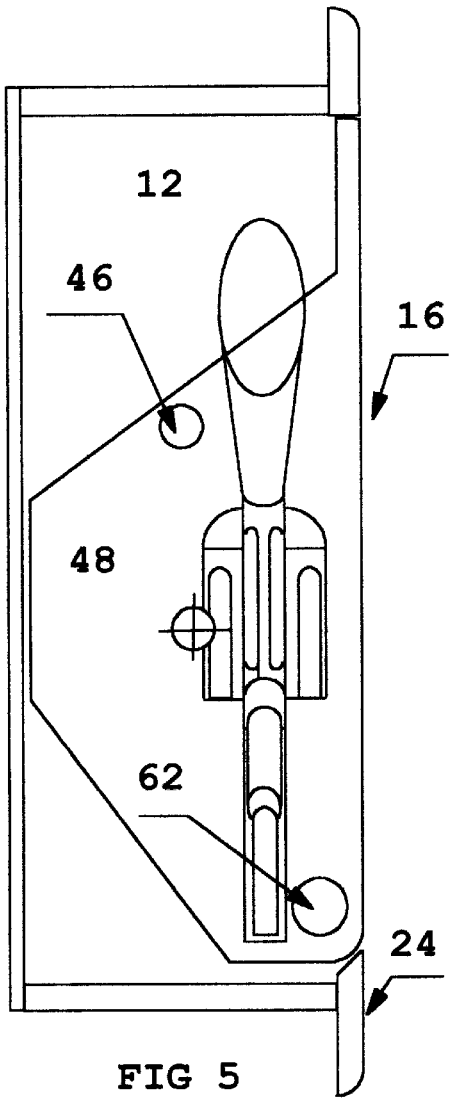
FIG. 5 is an elevational cross-sectional view taken along line 5—5 of FIG. 4.
Figure 6:
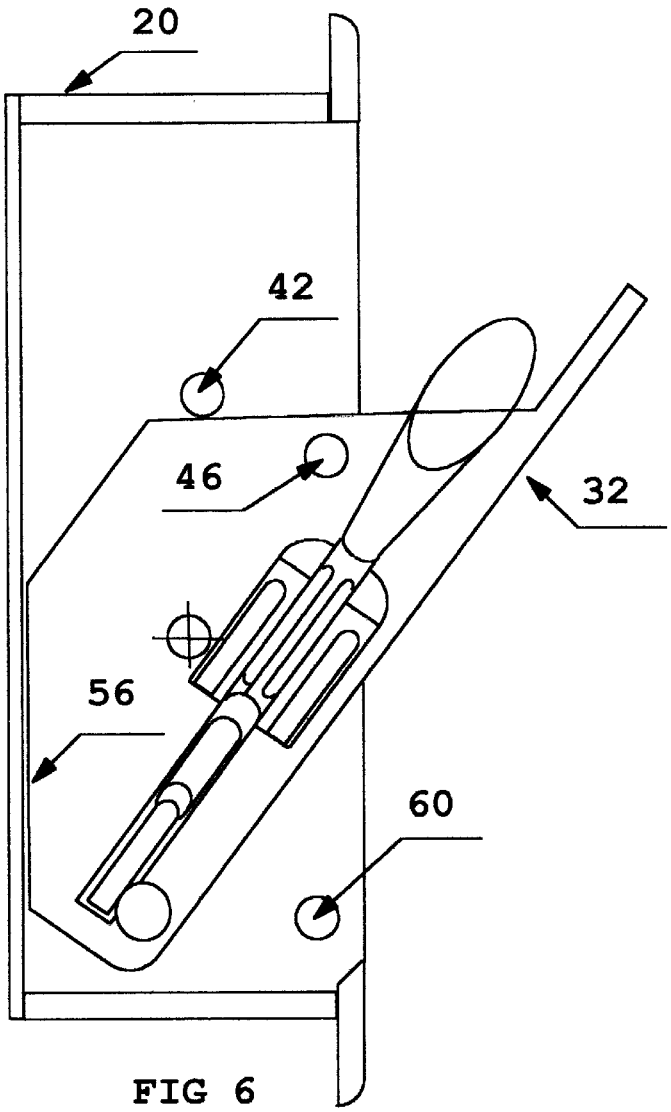
FIG. 6 evational cross-sectional view similar to FIG. 5, but showing the weapon hopper in the "opened" condition.

Turning to FIGS. 4–6, hopper 16 is suitably sized and shaped to provide adequate storage space for hand gun, pistol or similar small weapon substantially as shown. The hopper 16 is pivotally mounted in its compartment 12 by a pair of opposed, horizontally aligned axles 34, 36 which define a horizontal pivot axis such that when a capture means (to be subsequently described) is released, the hopper pivots outwardly about the axis with respect to box-like structure 20 from a first closed condition (FIG. 5) where the weapon therein is completely and securely enclosed to a second open or accessible condition (FIG. 6) permitting the weapon easily to be withdrawn through the top opening of the hopper. As depicted, hopper 16 has an asymmetrical configuration featuring its somewhat enlarged front panel 32 which in the closed condition elevated the center of gravity of the hopper above the pivot axis and thereby causes the hopper to fall under the influence of gravity when the capture means its released.

In its preferred form, the hopper capture means comprises a DC solenoid latch assembly 40 mounted in the upper portion of compartment 14 via bracket 41. Solenoid latch assembly included a locking pin or plunger 42 extending parallel to the pivot axis defined by hopper axles 34, 36 with the pin 42 extending through a first opening 44 in divider wall 22 and then through a second aligned opening 46 in the sidewall 48 of hopper 16. A helical spring 50 engaged between solenoid support bracket 41 and a fixed retainer washer or ring on the pin (not shown) normally maintains the pin in the extended or "de-energized" position of the solenoid. In this position solenoid pin 42 extends through the opening 46 in the hopper sidewall 48 and normally maintains the hopper in the latched or closed position preventing access to the weapon stored in the hopper (see FIGS. 1 & 5).

In operation of apparatus 10, upon occurrence of secure or restricted access event, a suitable electrical signal energizes the coil of the latching solenoid assembly thereby causing the solenoid pin to move to the right as viewed in FIG. 4. This action causes pin 42 to retract from opening 36 in sidewall 48 of the hopper, which in turn, enables the hopper to pivot forwardly about the pivot axis under the force of gravity to assume the open position of FIG. 6. It will be noted that in the closed position of the hopper, rear hopper panel 56 may serve as an abutment or stop against the rear panel surface of box like structure 20. The solenoid assembly 40 is of the well-known type that will automatically reset to its normally locked or un-retracted condition after a predetermined time delay and by virtue of its cam shaped distal extremity will be re-engaged in the opening 46 in the sidewall 48 of the hopper when the hopper is pivotally returned to its closed or upright position (FIG. 5) thereby automatically locking the hopper in such closed position.

As shown in FIG. 4, a microswitch 60 is mounted on the panel divider wall 22 near the bottom thereof. Oppositely mounted on the hopper sidewall 48 in a confronted relation with microswitch 60 is a ferromagnetic control element 62 which normally maintains the microswitch shunted to the "off" condition. However, when the hopper is pivotally opened (FIG. 6), the magnetic control element 62 is tilted away from the microswitch 60 thereby turning the microswitch 60 "on" and causing the latter to transmit a suitable electrical signal to the control circuit of the apparatus, or to a remote control circuit. This electrical signal generated by microswitch 60 thus detects operation of the hopper from the closed condition to the open condition and may be used to trigger a local alarm or provide the open circuit needed for use in a security or restricted access control panel to activate an alarm. Preferably, a suitable terminal strip 64 is provide in compartment 14 to which connections of the various electrical control components conveniently may be made. It will be appreciated that a control device such as a card reader, finger print reader, proximity reader, or other similar industry restricted access devices such as the keypad 28 (FIG. 2) may be used to provide an encoded input signal effective to energize the solenoid assembly 40 to an "on" condition and thereby open the hopper on demand by an authorized person.

Figure 7:
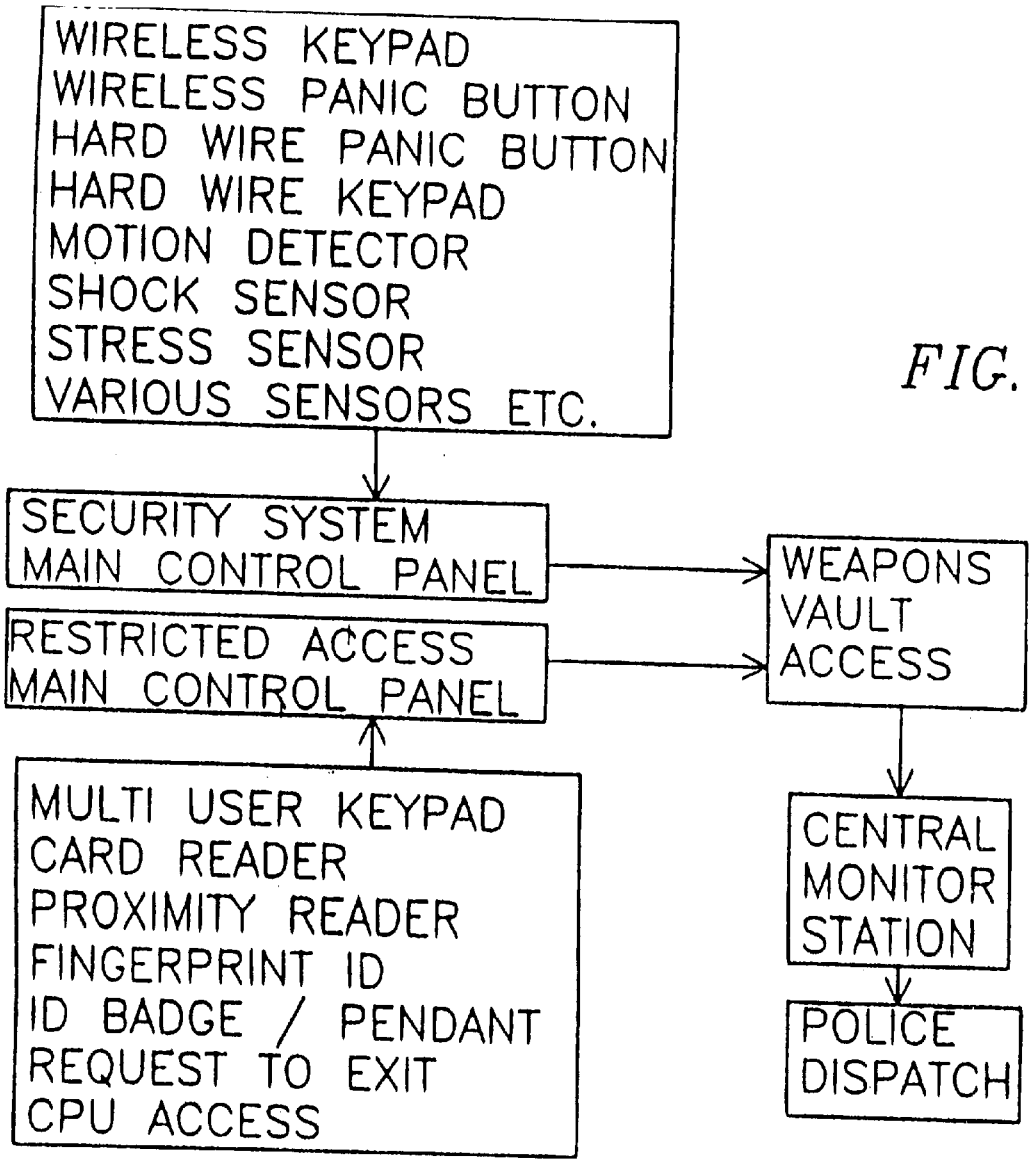
FIG. 7 is a schematic circuit diagram of a preferred control system for operating the weapon enclosure apparatus according to the present invention.
Figure 8:
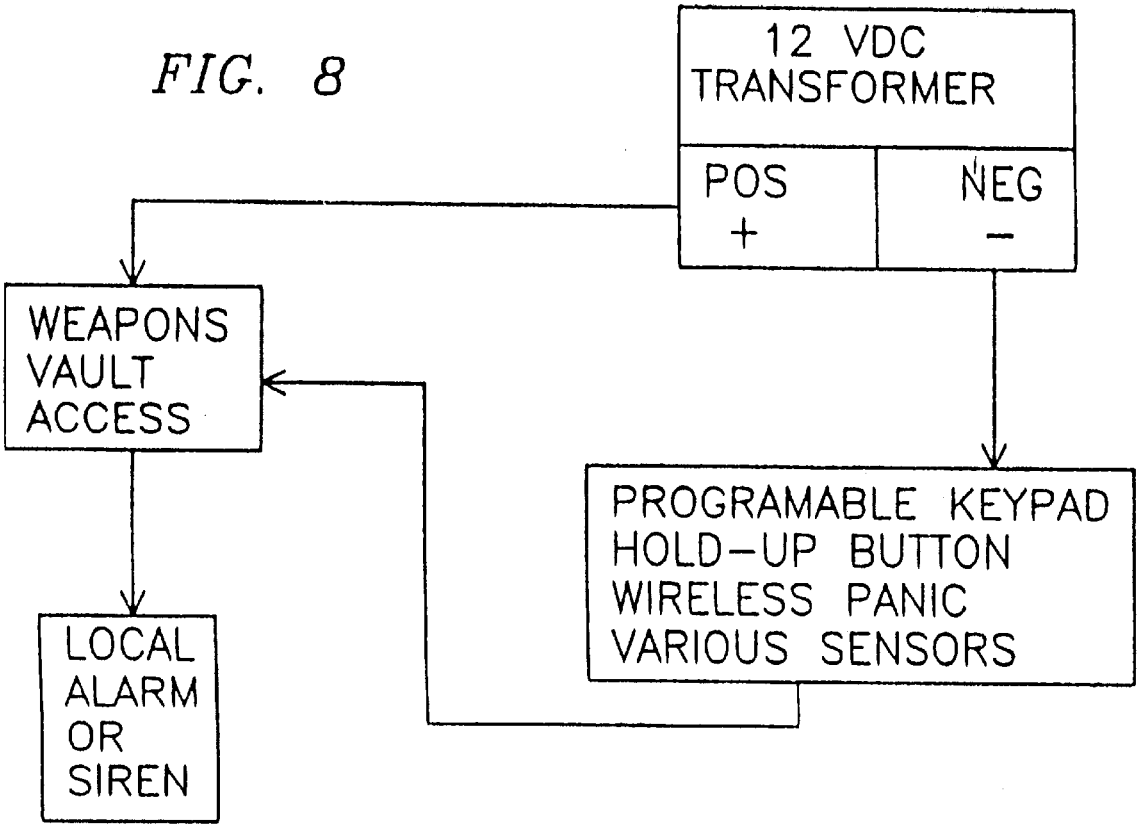
FIG. 8 is a schematic circuit diagram of an alternatively preferred control system in the stand alone application for operating the weapon security apparatus according to the present invention.

The schematic block diagram of FIG. 7 shows the Weapon Security Apparatus integrated in an overall security system where opening and closing of the hopper (e.g. presence of signal from microswitch 60) is monitored by a remote station capable of dispatching police help. FIG. 8 shows a schematic block diagram of a "stand alone" system where the opening of the hopper automatically triggers a siren or other alarm.

I claim:

1. A gun safe for use as an accessory in the security and restricted access industry, adapted to be mounted to a wall, comprising:

a box including a mounting frame for mounting the box on or within a wall, said box having a hollow interior portion partitioned by a dividing wall into a main compartment and an access compartment, situated generally side-by-side;

said main compartment houses an asymetrically shaped hopper having a first side wall which abuts a side of the box and a second side wall which abuts the dividing wall between the compartments, said hopper having a hopper opening in an upper portion of the second side wall adjacent the dividing wall which cooperates with a hopper latching mechanism, said hopper further comprising an interior portion adapted to receive and hold a handgun or pistol, said hopper being pivotally mounted to the main compartment along a horizontal axis by a horizontal axle mounted to a lower portion of the main compartment, such that upon actuation of the hopper latching mechanism, the hopper is released to rotate downwardly under the influence of gravity from a first closed position within the main compartment to a second open position allowing access to the interior portion of the hopper and permitting withdrawal of the handgun therein through a top opening in the hopper;

said access compartment comprising an access panel with an electronic keypad thereon which actuates said hopper latching mechanism, the hopper latching mechanism including a 12 volt DC solenoid mounted within an upper portion of the access compartment and having an armature engageable with the opening on the second side wall of the hopper, the solenoid armature has a spring bias and a rounded, cam shaped distal end which is automatically reset to engage the hopper opening when the hopper is brought to the first closed position, and upon energization of the solenoid, the armature is retracted from the hopper opening;

the access compartment further comprises an access panel cover hingedly mounted along a vertical axis to one side of the box and covering the access panel and compartment;

said hopper further comprising a magnet element fixed to a lower portion of said second side wall to cooperate with an indicator microswitch mounted to the access compartment;

a terminal strip is mounted to the access compartment to allow connection to electrical components;

whereby, in operation, the access panel cover is opened to allow access to the keypad and upon energization of the solenoid, the solenoid armature is retracted from the hopper opening and the hopper is released to pivot downwardly allowing access to the handgun therein.

* * * * *